United States Patent [19]

McVey et al.

[11] 3,992,642

[45] Nov. 16, 1976

[54] CERAMIC ENVELOPE PLUG AND LEAD WIRE AND SEAL

[76] Inventors: Charles I. McVey, 3316 Ardmore Road, Shaker Heights, Ohio 44120; Robert L. Kelling, 7473 Hughes Road, Ravenna, Ohio 44266

[22] Filed: Dec. 15, 1975

[21] Appl. No.: 640,805

[52] U.S. Cl. ..... 313/43; 313/42; 313/217; 313/331

[51] Int. Cl.[2] ..... H01J 61/52

[58] Field of Search ..... 313/42, 43, 217, 331

[56] References Cited

UNITED STATES PATENTS 3,363,133 1/1968 Harris et al. ..... 313/217

3,609,437 9/1971 Tol et al. ..... 313/220

*Primary Examiner*—R. V. Rolinec
*Assistant Examiner*—Darwin R. Hostetter

[57] ABSTRACT

A metal vapor arc lamp comprises an alumina ceramic arc tube having an end sealed by an apertured ceramic plug. A metal lead wire extending through the aperture is sealed therein, and supports an electrode within the arc tube. Thermal isolation of the lead wire seal from the electrode is necessary and is achieved by providing a loop in the supporting conductor intervening between the electrode and the lead wire seal region.

6 Claims, 4 Drawing Figures

CERAMIC ENVELOPE PLUG AND LEAD WIRE AND SEAL

The invention relates generally to arc discharge lamps utilizing alumina ceramic envelopes, and more particularly to their end and inlead seal structures.

BACKGROUND OF THE INVENTION

Alumina ceramic envelopes are of particular interest in connection with high pressure sodium vapor lamps which are now widely used for outdoor lighting applications on account of their high efficacy, generally in excess of 100 lumens per watt. Alumina ceramic is resistant to sodium at high temperatures and both high density polycrystalline alumina and monocrystalline alumina or synthetic sapphire are utilized for lamp envelopes. The lamp fill comprises sodium along with a rare gas to facilitate starting, and mercury for improved efficiency. The ends of the alumina tube are sealed by suitable closure members affording connection to thermionic electrodes. The ceramic arc tube is generally supported within an outer vitreous envelope or jacket provided at one end with a mogul screw base. The electrodes of the arc tube are connected to the terminals of the base, that is to shell and center contact, and the inter-envelope space is usually evacuated in order to conserve heat.

One design of end seal for an alumina ceramic arc tube which is described in U.S. Pat. No. 3,882,346 - McVey, utilizes a ceramic plug sealed in the end of the arc tube and having a central perforation through which is sealed a lead wire of ceramic-matching metal, that is, of metal which approximately matches the coefficient of expansion of the ceramic, preferably niobium or alternatively tantalum in the case of alumina ceramic. The sealing is effected through a glassy sealing composition which melts when the assembly is suitably heated and forms the ceramic-to-ceramic and ceramic-to-metal seals.

Such a seal design is more economical than a conventional one using a thin-walled niobium tube. But because a solid wire cannot give or deform as readily in response to thermally-induced stress as a thin-walled tube, it is a more critical design. A problem which has been encountered with it is occasional fracture of the hermetic seal, particularly at the lead wire, and the object of the invention is to remedy this shortcoming.

SUMMARY OF THE INVENTION

We have determined that the seal failures are due to excessive temperature or temperature gradient along the bonded surfaces or across them where the lead wire extends through the apertured ceramic plug. A remedy is to provide thermal isolation of the lead wire seal from the electrode. In accordance with the invention it is achieved by providing a loop in the supporting conductor intervening between the electrode and the lead wire seal region. Such loop provides the necessary thermal isolation while allowing sufficient heat from the arc and from the electrode structure to reach the join of the ceramic plug and tube to prevent condensation of sodium-mercury amalgam there during operation. The loop additionally supports the ceramic plug during sealing.

DETAILED DESCRIPTION

Figure 1:
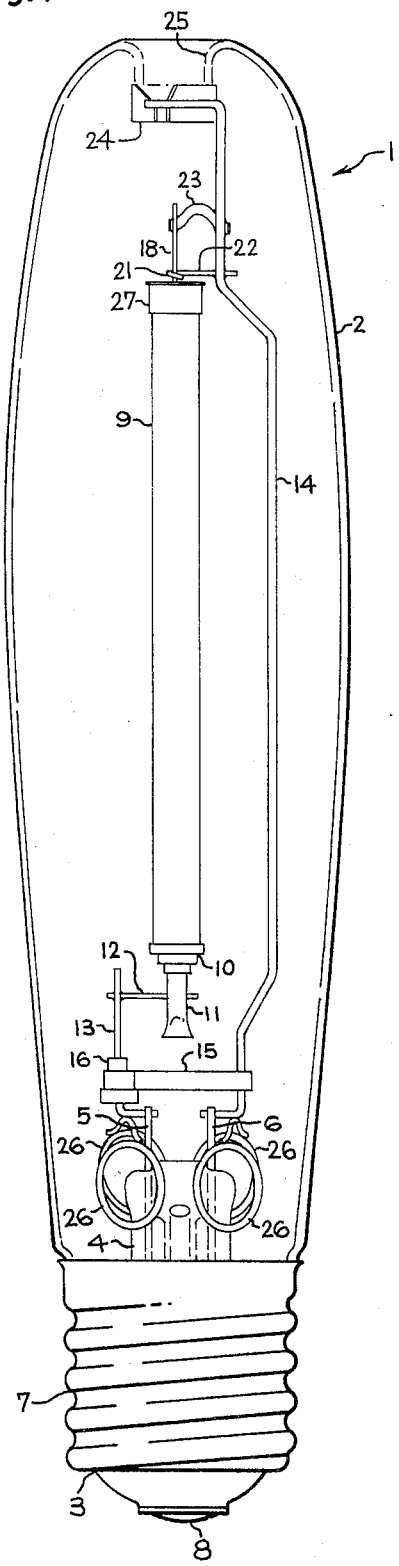
FIG. 1 is a side elevation view of a ceramic arc tube lamp embodying the present invention.

A high pressure sodium vapor lamp 1 embodying the invention in preferred form and corresponding to a 400-watt size is illustrated in FIG. 1. It comprises a vitreous outer envelope 2 with a standard mogul screw base 3 attached to one end and comprising a re-entrant stem press 4 through which extend, in conventional fashion, a pair of relatively heavy lead-in conductors 5,6 whose outer ends are connected to the screw shell 7 and eyelet 8 of the base.

The arc tube 9 centrally located within the outer envelope comprises a piece of crystalline alumina tubing having its lower end closed by a metal end cap 10, suitably of niobium which matches the expansion coefficient of alumina ceramic. A metal tube 11 which may also be of niobium is hermetically sealed through the cap and serves as an exhaust and fill tubulation during manufacture of the lamp. The exhaust tube is sealed off at its outer end and serves as a reservoir in which excess vaporizable metal, sodium-mercury-amalgam in this case, condenses during operation of the lamp. The lower electrode within the lamp is attached to the inward projection of tube 11. A short wire connector 12 is welded to tube 11 and to short support rod 13 which in turn is welded to lead-in conductor 5. Support rod 13 is braced to single side rod 14 welded to lead-in conductor 6, by means of a strap 15 attached to the side rod and wrapping around an insulator 16 threaded over support rod 13.

Figure 2:
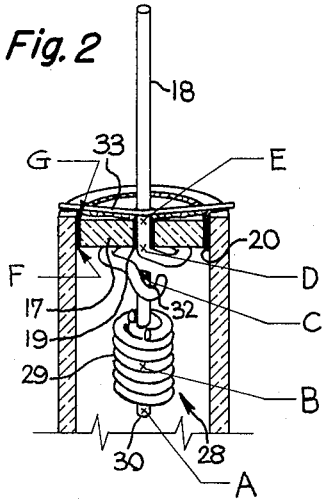
FIG. 2 is a fragmentary pictorial view of the sectioned upper end of the sarc tube.

The upper end of the arc tube is sealed by a perforated alumina ceramic plug 17 best seen in FIG. 2. As illustrated, the plug is centrally perforated and a niobium inlead wire 18 extending through the hole is hermetically sealed by sealing composition indicated at 19. The plug in turn is hermetically sealed into the end of arc tube 9 by a ring of sealing composition indicated at 20. The inlead supports the upper electrode within the arc tube, and its external portion passes through a loop 21 in transverse support wire 22 attached to side rod 14. This arrangement allows for thermal elongation of the arc tube during operation, and a resilient metal ribbon 23 assures a good electrical connection. The upper end of side rod 14 is braced by spring clamp 24 which engages inverted nipple 25 in the dome end of the outer envelope. The outer envelope or jacket is evacuated by pumping and flashing getter rings 26. A metal band 27 may be desirable around the upper end of the arc tube in order to maintain the desired temperature, particularly in smaller sizes of lamps, for instance 250 watts or less.

The illustrated lamp is intended for base down operation and has the amalgam reservoir 11 lowermost. In a similar design for base up operation, the arc tube is reversed end for end relative to the outer envelope in order to have the amalgam reservoir lowermost, and the attachments or supports for the arc tube including the expansion slip loop 21 are reversed appropriately.

The hermetic seals, including that of the inlead wire through the ceramic plug and that of the plug to the arc tube may be made using various sealing compositions, sometimes referred to as sealing glass, which comprise primarily aluminum oxide and calcium oxide. One composition which we have used successfully is designated G-54 and consists of approximately 54.0% $Al_2O_3$, 38.5% CaO, and 7.5% MgO by weight. Other compositions which may be used are those described in U.S. Pat. Nos. 3,281,309 - Ross, 3,441,421 - Sarver et al., and Pat. 3,588,577 - McVey.

The lamp utilizes self-heating thermionic electrodes 28 best seen in FIG. 2. The electrode comprises two helical layers 29 of tungsten wire wound around a tungsten shank 30. The inner helical layer has spaced turns and electron emitting material such as dibarium calcium tungstate $Ba_2 CaWO_6$ is enclosed in the interstices between turns. The inner end of inlead 18 is bent sharply to a radial direction immediately beyond the hole through plug 17 and then curves into a ring-like loop 31 which terminates in an inwardly and downwardly directed extension to which the shank 30 of the electrode is welded at 32.

Figure 3:
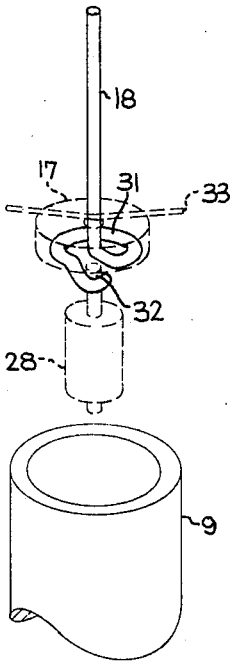
FIG. 3 shows the ceramic plug, lead, and electrode assembly ready to be lowered into the arc tube end for sealing.

Loop 31 defines a plane surface and serves as a platform to support ceramic plug 17 prior to sealing. The inlead, electrode and ceramic plug assembly prior to sealing is best seen in FIG. 3 wherein the plug and electrode are shown in phantom. A light wire cross-piece 33 is spot welded to inlead 18 just above plug 17 and serves to support the assembly when it is lowered into the open end of arc tube 9. The cross piece is bent or arched slightly about its midpoint in a horizontal plane in order to have its ends engage the edge of the arc tube in a vertical diametral plane whereby the assembly will hang vertically in the tube. Sealing composition or frit is placed on the ceramic plug and the assembly is then heated to the melting temperature of the glass frit so that the seals form upon cooling. As illustrated, cross piece 33 is disposed close to the surface of ceramic plug 17 in order to serve as a wick for molten sealing frit during the sealing operation. The distribution of sealing frit between the peripheral seal of arc tube to plug, and the central seal of plug to inlead, is thereby equalized. This feature is more fully described and is claimed in the copending application of Charles I. McVey, filed of even date herewith, entitled "Ceramic Lamp Seal and Control of Sealing Frit Distribution", and similarly assigned.

Figure 4:
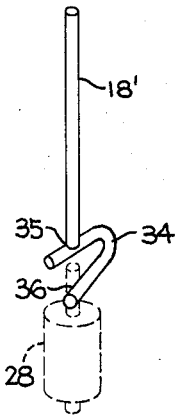
FIG. 4 shows a variant of the lead and electrode assembly.

FIG. 4 illustrates a variant of the lead and electrode assembly wherein the inner portion of the niobium inlead 18' is cut off at a point corresponding to emergence from the aperture through the ceramic plug. A small U-shaped connector piece 34, preferably of niobium, is welded at 35 to the distal end of the inlead to form a cross support or hanger. The upper leg of connector 34 then serves to support the ceramic plug prior to and during sealing, and the electrode shank is welded at 36 to the lower leg.

In both the single piece inlead construction of FIGS. 2 and 3, and the two piece inlead construction of FIG. 4, pressure may be used during the resistance welding of the tungsten electrode shank 30 to the end of niobium inlead 18 or to niobium connector piece 34. This permits the hard tungsten to deform the relatively soft niobium whereby a large area bond is achieved having adequate strength to support the relatively massive tungsten electrode notwithstanding vibration and shocks during use.

The reliability of ceramic-to-metal seals is detrimentally affected by excessive temperature or temperature gradient along the bonded surfaces or across them. In the end structures of ceramic discharge lamps very high temperature gradients occur. Thus plasmas whose temperatures may exceed 3000° C are sustained by refractory electrodes whose inleads extend through ceramic-to-metal seals. These seals may fracture and their lives are drastically shortened at temperatures in excess of 800° C. The electrode coil structure contains electron emission material and it must operate at a temperature high enough to effect a slow release of those elements that activate the electrode for efficient electronic emission. The conflicting requirements of a hot electrode and a much cooler electrode inlead seal are reconciled in accordance with the invention by loop 31 in the niobim inlead which lengthens the thermal conduction path from electrode shank 30 to the inlead seal. The u-shaped connector piece 34 performs the same function in the embodiment of FIG. 4.

Typical temperatures encountered in a 400-watt high pressure sodium lamp such as illustrated in FIG. 1 are given in Table 1 below. The corresponding temperature points are indicated in FIG. 2.

TABLE 1

| | LOCATION | TEMPERATURE |
|---|---|---|
| A: | electrode shank tip | 1600° C |
| B: | electrode coil | 1300° C |
| C: | shank rear end | 1100° C |
| D: | inlead seal-inside | 800° C |
| E: | inlead seal-outside | 750° C |
| F: | ring seal-inside | 750° C |
| G: | ring seal-outside | 730° C |

It will be observed in the above table that the axial temperature drop along the length of the wire seal from inside to outside surface of the ceramic plug is only 50° C. The temperature drop from inside to outside of the ring seal between the arc tube and plug is only 20° C. Thus the requirement of an electrode coil or body at 1300° C and an inlead seal not above 800° C are reconciled and a small temperature gradient along the seal is achieved.

What we claim as new and desire to secure by Letters Patent of the United States is:

1. A high pressure sodium vapor lamp comprising:

a tubular light-transmitting ceramic envelope having end closures and thermionic electrodes sealed into its ends and containing inert starting gas and a charge including an excess of vaporizable metal;

the closure at one end of said envelope comprising a ceramic plug having a perforation and ceramic-matching metal inlead wire sealed therethrough;

the electrode at said one end being attached to said inlead through an intervening loop of a conductor providing thermal isolation between the electrode and the inlead seal.

2. A lamp as in claim 1 wherein the inner portion of said inlead wire is bent to a radial direction immediately beyond said perforation and the curves into a ring-like loop terminating in an inwardly and downwardly directed extension to whih said electrode is attached.

3. A lamp as in claim 1 wherein a connector piece is attached to the distal end of the inner portion of said inlead wire and said electrode is attached to said connector piece which forms said intervening loop.

4. A lamp as in claim 1 wherein the ceramic is alumina and said inlead is of niobium, and the electrode comprises a tungsten coil on a tungsten shank attached to the distal end of said intervening loop.

5. A lamp as in claim 1 wherein said inlead wire is bent to a radial direction immediately beyond said perforation and then curves into a ring-like loop terminating in an inwardly and downwardly directed extension, and said electrode comprises a tungsten coil on a tungsten shank welded to the end of said extension.

6. A lamp as in claim 5 wherein the envelope is alumina and said inlead wire is of niobium.

* * * * *

UNITED STATES PATENT OFFICE

CERTIFICATE OF CORRECTION

PATENT NO. : 3,992,642

DATED : December 15, 1975

INVENTOR(S) : Charles I. McVey and Robert L. Kelling

It is certified that error appears in the above-identified patent and that said Letters Patent are hereby corrected as shown below:

On the cover sheet, add the following:

-- [73] Assignee: General Electric Company, Schenectady, N.Y. --.

Signed and Sealed this

Twelfth Day of April 1977

[SEAL]

*Attest:*

RUTH C. MASON
*Attesting Officer*

C. MARSHALL DANN
*Commissioner of Patents and Trademarks*